US005203873A

United States Patent [19]

Corsmeier et al.

[11] Patent Number: 5,203,873

[45] Date of Patent: Apr. 20, 1993

[54] TURBINE BLADE IMPINGEMENT BAFFLE

[75] Inventors: Robert J. Corsmeier; Harvey M. MacLin, both of Cincinnati, Ohio

[73] Assignee: General Electric Company, Cinncinnati, Ohio

[21] Appl. No.: 752,141

[22] Filed: Aug. 29, 1991

[51] Int. Cl.[5] ..... F01D 5/08

[52] U.S. Cl. ..... 416/96 A; 416/97 R

[58] Field of Search ..... 415/115, 116; 416/96 A, 416/97 R, 97 A

[56] References Cited

U.S. PATENT DOCUMENTS

| | | | |
|---|---|---|---|
| 2,848,192 | 8/1958 | Hayes . | |
| 3,373,970 | 3/1968 | Brockman | 416/97 R |
| 3,627,443 | 12/1971 | Pirzer | 415/115 |
| 3,697,192 | 10/1972 | Hayes . | |
| 3,806,276 | 4/1974 | Aspinwall | 415/115 |
| 3,972,874 | 8/1976 | Corsmeier et al. . | |
| 4,025,226 | 5/1977 | Hovan | 415/115 |
| 4,413,949 | 11/1983 | Scott | 416/97 R |
| 4,441,859 | 4/1984 | Sadler | 416/96 A |
| 4,462,754 | 7/1984 | Schofield | 415/116 |
| 4,484,859 | 11/1984 | Pask et al. | 416/96 A |
| 4,767,268 | 8/1988 | Auxier et al. | 415/115 |
| 4,820,122 | 4/1989 | Hall et al. | 416/97 R |

FOREIGN PATENT DOCUMENTS

| | | | |
|---|---|---|---|
| 59-200001 | 11/1984 | Japan . | |
| 0811586 | 4/1959 | United Kingdom | 416/97 R |
| 017229 | 10/1979 | United Kingdom | 415/115 |

*Primary Examiner*—Edward K. Look
*Assistant Examiner*—Christopher M. Verdier
*Attorney, Agent, or Firm*—Jerome C. Squillaro

[57] ABSTRACT

An impingement-cooled gas turbine blade includes an impingement baffle which, during engine operation, is subject only to shear loading. A tubular baffle body is provided with a pair of mounting flanges which are bonded between a forward portion of the turbine blade and an aft portion of the turbine blade. The bond extends from the blade dovetail to the blade tip.

14 Claims, 4 Drawing Sheets

TURBINE BLADE IMPINGEMENT BAFFLE

The government has rights in this invention pursuant to Contract No. F33615-87-C-2764 awarded by the Department of the Air Force.

BACKGROUND OF THE INVENTION

1. Field of the Invention

The present invention relates generally to gas turbine engines and particularly concerns the mounting of an impingement baffle within a turbine blade so as to virtually eliminate tension and/or compression loading of the baffle during engine operation.

2. Description of Prior Developments

Gas turbine engine components such as turbine blades and turbine vanes are exposed to extremely high operating temperatures. Without highly efficient cooling, these components would likely fail due to overheating. One of the best known methods of cooling such components is impingement cooling which directs multiple streams or jets of cooling air through a perforated baffle to impinge against the surfaces to be cooled. Because impingement cooling has a very high heat transfer coefficient, virtually all known turbine nozzle stator vanes and some high pressure turbine blades are presently cooled by impingement cooling.

Although impingement cooling has proven to be a generally reliable method of cooling, a particular problem has long been associated with the mounting of an impingement baffle within the interior of a gas turbine engine blade. Specifically the high tension loads applied to the impingement baffle during engine operation occasionally cause the joint or joints between the impingement baffle and turbine blade to fail.

Such failure typically occurs at the root of the impingement baffle where it is usually secured by a brazed joint to the turbine blade at a location just below or radially inwardly of the turbine blade platform. Upon rotation of the turbine blade and its internally mounted impingement baffle, the resulting high centrifugal forces place the turbine blade, impingement baffle and its brazed joint in significant tension.

In addition to the problem of high tension loading, another problem associated with conventional impingement baffles concerns the high vibrational forces applied to the baffles during engine operation. Such forces arise due to the difference in vibration frequencies between the baffles and the turbine blade airfoils within which the baffles are secured. Even with the placement of vibration dampers between the impingement baffles and blade walls, the combination of high tension loading and high vibrational stresses has inhibited the application of impingement cooling to turbine blades, particularly high pressure turbine blades having impingement baffles mounted therein by brazing.

Manufacturing problems also arise during fabrication of a conventional turbine blade and impingement baffle assembly. In order to position and space the impingement baffle a predetermined distance from the inner walls of a turbine blade airfoil to achieve effective impingement cooling, standoff bosses are provided on the outer surfaces of the baffles. These bosses also help to reduce vibration of the baffle within the turbine blade. A good fit between the standoff bosses and the inside surface of the turbine blade airfoil is difficult to obtain and requires careful machining.

In addition, some current high-work turbine blades have airfoil leading edges that are angled toward or away from their direction of rotation at a location above the pitch section near the blade tip. It is unlikely that a conventional impingement baffle could be installed within such an airfoil blade, either from its tip or from its root.

It has been considered to seat the impingement baffles against the inside of the turbine blade airfoil tip and thereby place the baffles in compression during engine operation. Unfortunately, this approach has not proven feasible because the blade airfoil is not strong enough to carry the weight of the baffle under centrifugal loading. Furthermore, because this mounting approach requires that the baffle not be brazed at its root, a portion of the cooling air is allowed to leak around the baffle root instead of flowing into it.

Accordingly, a need exists for a reliable impingement-cooled turbine blade which virtually eliminates high tension loading of its impingement baffle without overloading the blade tip. A further need exists for an impingement baffle which can withstand all vibrational loading without requiring the use of separate vibration dampeners. An additional need exists for an impingement baffle which does not require the use of positioning standoff bosses. Still another need exists for an impingement baffle which may be easily adapted for mounting within advanced high-work turbine blades having angled or bent airfoil sections.

SUMMARY OF THE INVENTION

The present invention has been developed to fulfill the needs noted above and therefore has as an object the provision of an impingement baffle design for a gas turbine engine blade which virtually eliminates tension and compression loading of the baffle.

Another object of the invention is the provision of an impingement baffle which is free from high vibratory stresses.

Another object of the invention is the provision of an impingement baffle which obviates the need for standoff bosses and vibration dampeners.

Still another object of the invention is the provision of an impingement baffle which may be readily mounted within high-work turbine blades having leading edges which are angled or bent away from the direction of blade rotation.

Briefly, the invention is directed to an impingement baffle which is sandwiched and bonded between a forward portion of a turbine blade and a central or aft portion of a turbine blade. The impingement baffle extends over the full width and height of the turbine blade and in operation is in shear, rather than tension or compression, along its full length. Due to the large surface area and full extent of the bond between the impingement baffle and the turbine blade, sufficient support is provided to the impingement baffle so that no additional vibration dampeners are required.

Moreover, because the impingement baffle is subject only to shear forces, it is less likely to fail in use than prior baffles which were loaded in tension or compression. The shear forces are distributed along the full length of the baffle adjacent its bond which extends from the blade dovetail to the blade tip. The baffle, which is located inside the turbine blade, forms a portion of the blade exterior and actually serves as part of the blade structure and thereby provides support to the blade and to itself.

Because the impingement baffle is sandwiched between two portions of the turbine blades during assembly, the impingement baffle need not be inserted from the root or tip of the blade. This assembly approach allows the impingement baffle to be used with high-work turbine blades having leading edges which are angled away from the direction of blade rotation. Line of sight insertion clearances no longer present an assembly problem with the present invention.

The aforementioned objects, features and advantages of the invention will, in part, be pointed out with particularity, and will, in part, become obvious from the following more detailed description of the invention, taken in conjunction with the accompanying drawings, which form an integral part thereof.

BRIEF DESCRIPTION OF THE DRAWINGS

In the Drawings

In the various figures of the drawing, like reference characters designate like parts.

DETAILED DESCRIPTION OF THE PREFERRED EMBODIMENTS

Figure 1:
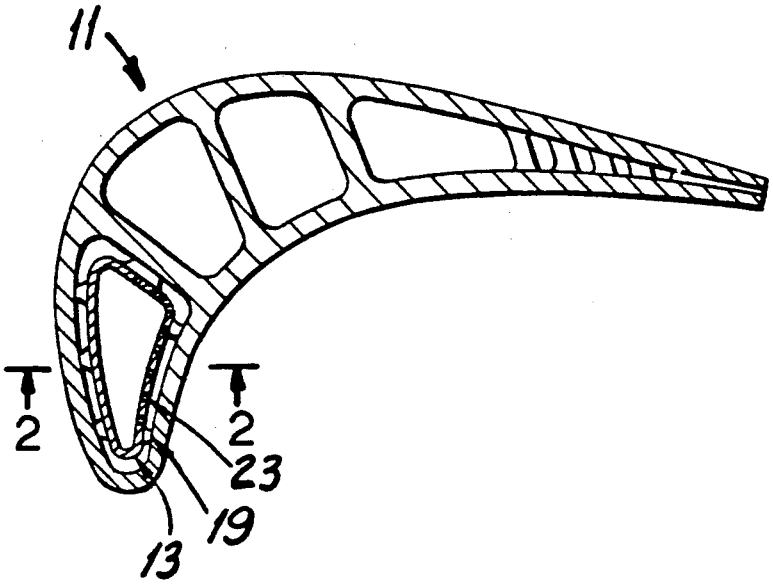
PRIOR ART FIG.1
FIG. 1 is a cross-sectional view through a gas turbine engine blade having an impingement baffle mounted therein according to the prior art.

In order to better appreciate the improvements of the present invention, it may be beneficial to review a typical example of an impingement-cooled turbine blade constructed in accordance with the prior art. Such a turbine blade is shown in FIGS. 1 and 2 wherein turbine blade 11 is provided with an impingement baffle 13 which is brazed at its root 15 to the turbine blade 11 along braze lines 17.

Impingement baffle 13 is positioned within turbine blade 11 with standoff bosses 19. Cooling air 21 enters the root of the turbine blade and passes radially through the impingement baffle 13 and then transversely or circumferentially through impingement holes 23 to cool the inner walls 25 of turbine blade 11 in a known fashion. During operation, the entire impingement baffle is subjected to tension loading due to centrifugal force. Even with the vibration damping effect of standoff bosses 19, the impingement baffle 13 is still subject to relatively high vibration-induced stress.

Figure 2:
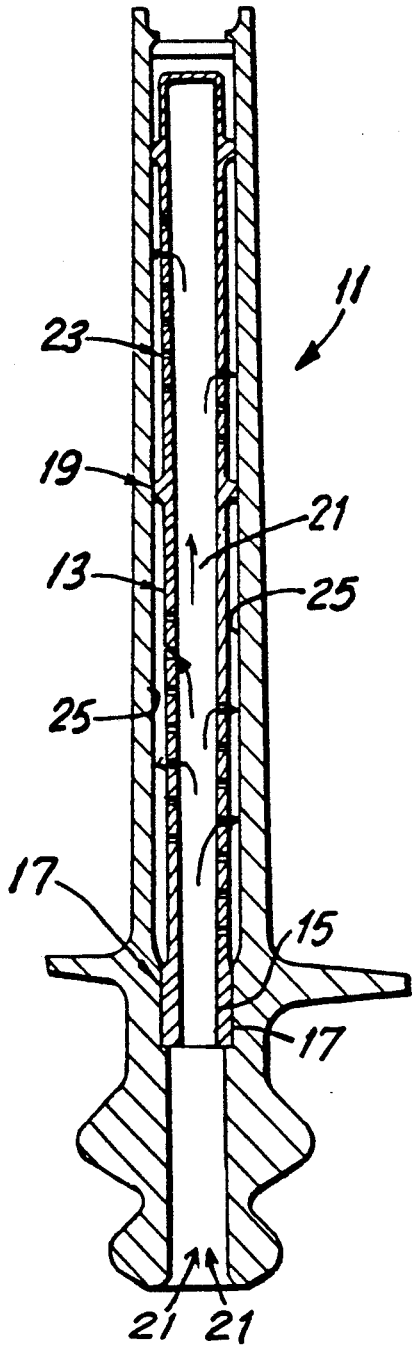
PRIOR ART FIG.2
FIG. 2 is a cross-sectional view taken through line 2—2 of FIG. 1.
Figure 5:
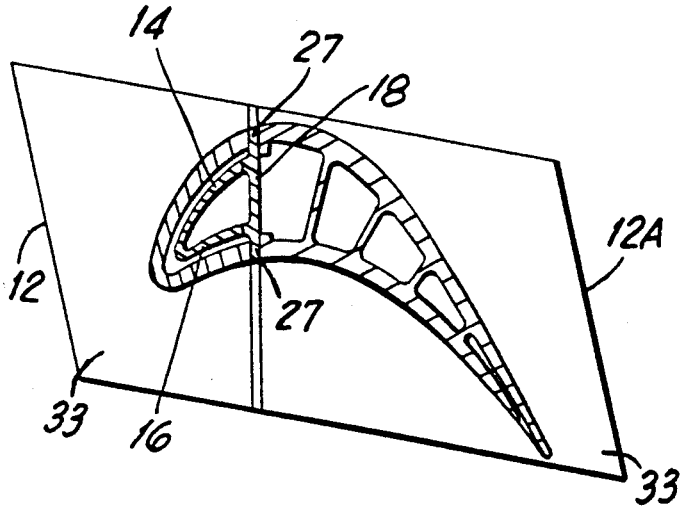
FIG. 5 is a cross-sectional view taken along line 5—5 of FIG. 3, looking downward or radially inwardly, and showing the blade platform and a section through the airfoil root.
Figure 6:
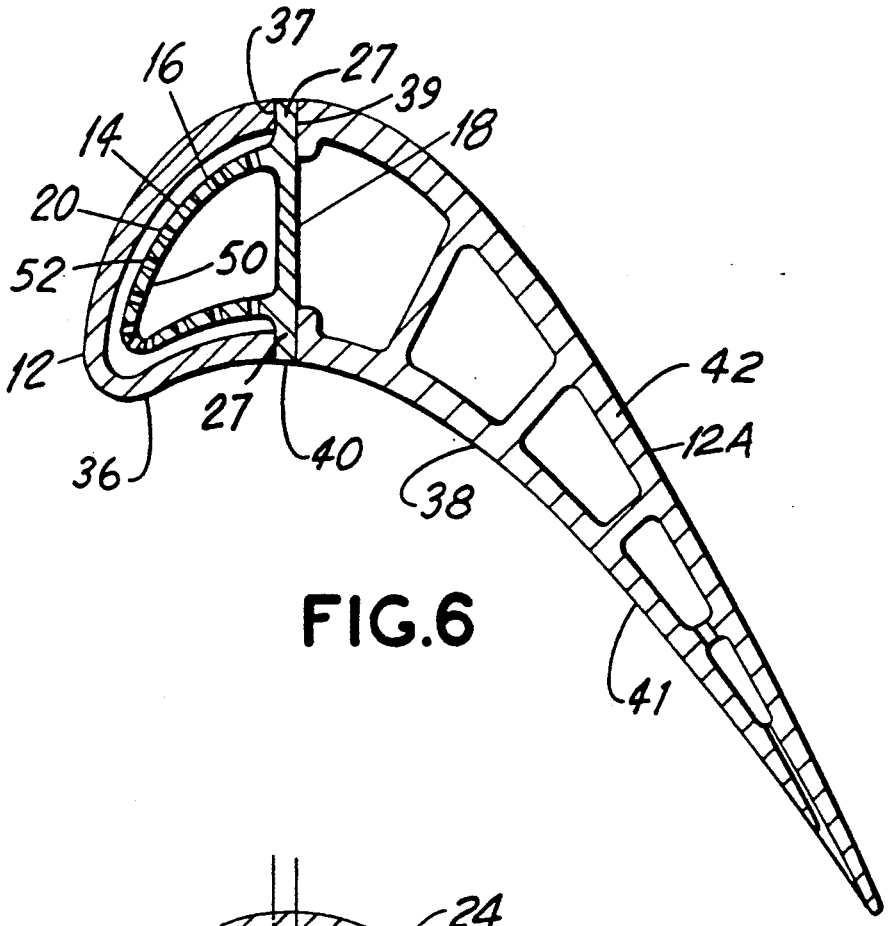
FIG. 6 is a cross-sectional view taken along line 6—6 of FIG. 3 showing a section through the airfoil pitch portion of the blade.

The tension, vibration and other previously noted drawbacks associated with the turbine blade design of FIGS. 1 and 2 have been overcome by the present invention which, by way of one example, is set forth in FIGS. 3 through 7. As seen in these Figures, the turbine blade 10 is made up of three major portions or parts, i.e., the blade front portion 12, the blade aft portion 12A and a tubular impingement baffle portion 14. As best seen in FIG. 6, blade front portion 12 includes an outer surface 36 and an aft surface 37, and blade aft portion 12A includes an outer surface 38 and a forward surface 39. A partially airfoil-shaped perforated impingement portion 16 of the impingement baffle 14 is integrally connected to a substantially planar baffle support plate 18. The impingement portion has opposite sides 50 and 52.

The impingement baffle 14 is best suited as a casting but it could also be fabricated. If the cast surfaces of the baffle support plate 18 are not acceptable in flatness, they can be easily machined. After drilling the impingement holes 20 in the baffle 14, it is ready for assembly.

Figure 7:
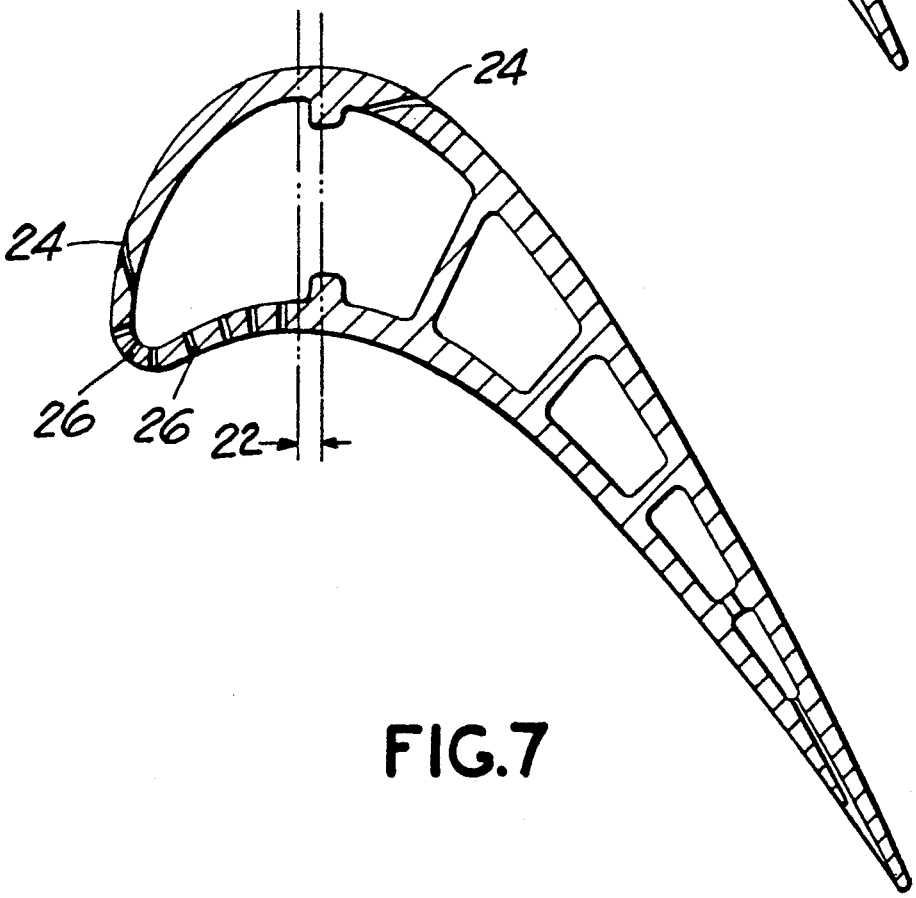
FIG. 7 is a cross-sectional view similar to FIG. 6, but showing the airfoil prior to being radially split or cut.

The turbine blade front portion 12 and turbine blade aft portion 12A can be cast as two separate parts or they can be cast as one blade unit and then cut apart through cut 22 as represented in FIG. 7. The width of cut 22 should be equal to the thickness of the baffle support plate 18. In this way, only one cutting pass is required.

After cutting the blade in two parts, or if it already is in two pieces, cooling air slots 24 and holes 26 can be machined into the blade airfoil. Since the blade is open and the inside walls of the airfoil are exposed, slots 24 may be formed with variable sections and contours and any sharp corners around the cooling holes can be removed by grit or bead blasting. In addition, the airfoil wall thickness of the two forward cavities which are later separated by impingement baffle 14 can be readily inspected.

The impingement baffle 14 is installed between the two blade portions 12 and 12A which are bonded together via transverse flanges 27 formed on support plate 18. Conventional bonding techniques such as diffusion bonding, welding or brazing can be employed to form the desired bond between the projecting flanges 27 and the turbine blade portions 12 and 12A. The bond may extend from the bottom of the blade through dovetail 29 through platform 33 and blade tip 35.

The periphery 40 of the baffle support plate 18 should be made a little larger or wider than the contour of the blade so it can be dressed down after bonding to smoothly meet the outer surface 41 of the blade airfoil 42, as best seen in FIG. 6, as well as the outer surfaces of the platform and shank. The dovetail 29 can then be machined on all three parts simultaneously.

Figure 9:
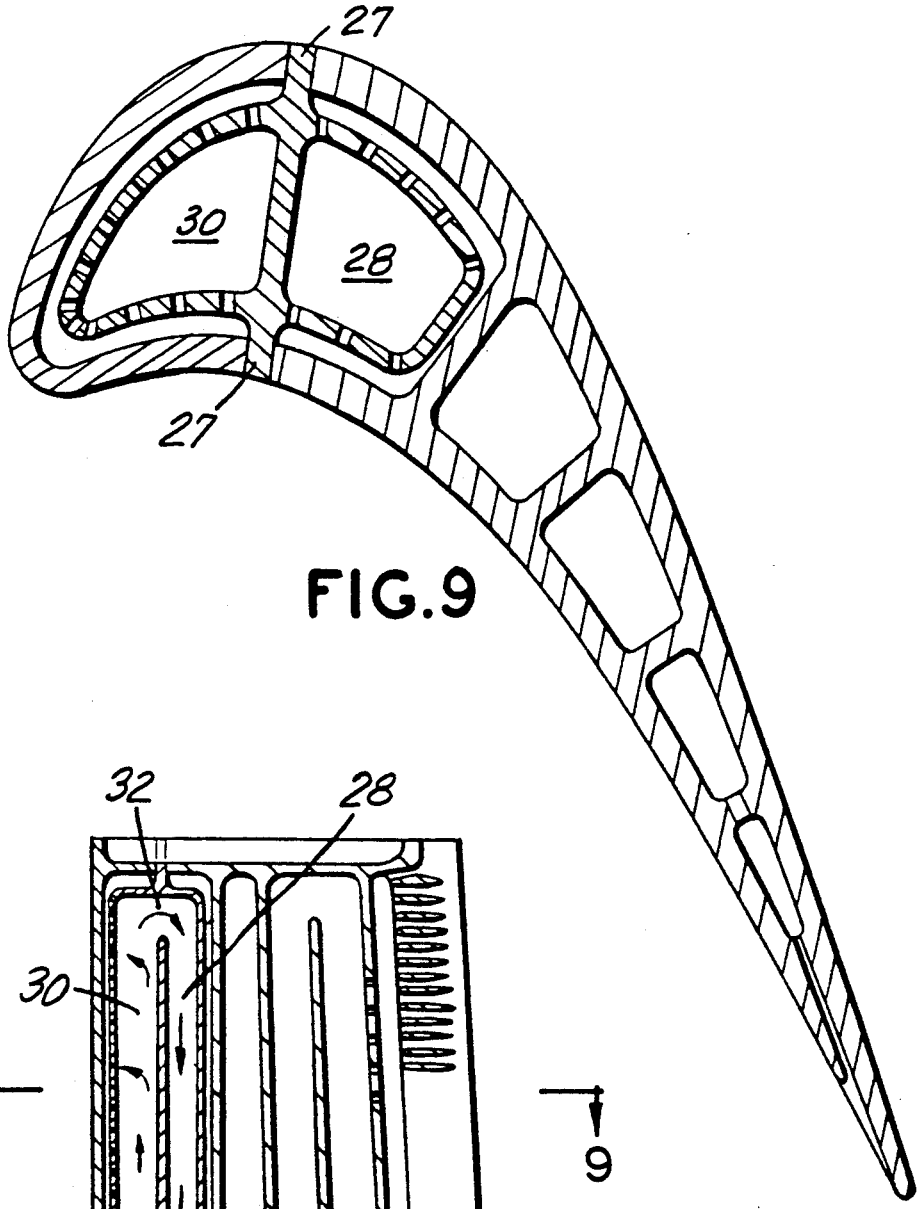
FIG. 9 is a cross-sectional view taken through line 9—9 of FIG. 8.
Figure 8:
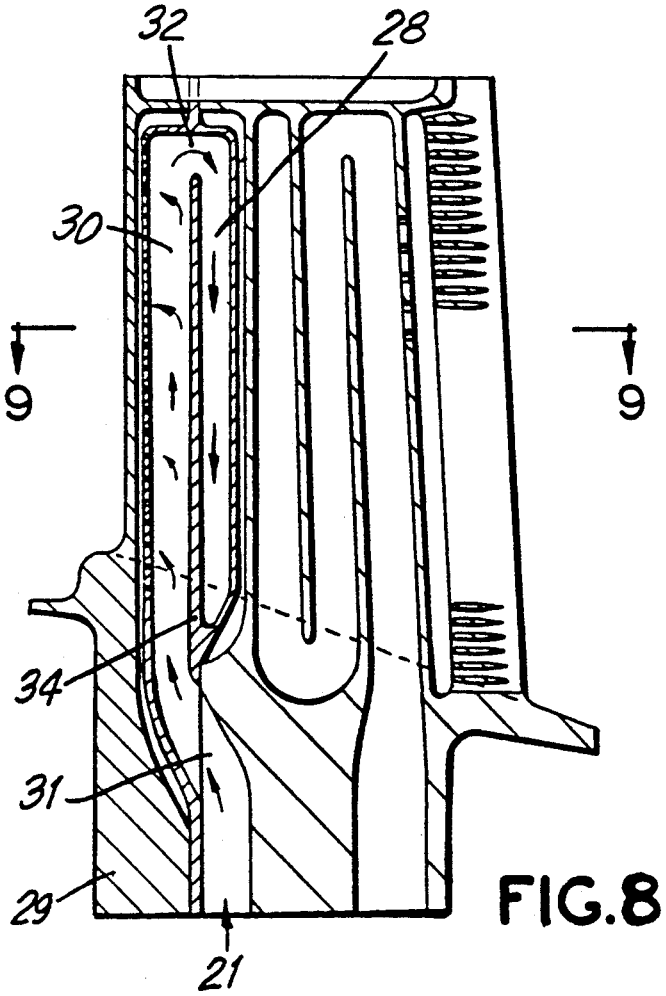
FIG. 8 is a view similar to FIG. 3 but depicting an alternate embodiment of the invention.

In order to increase the impingement area, an aft cavity 28 can be integrally added to the impingement baffle as seen in FIGS. 8 and 9. Cooling air 21 flows up through the forward cavity 30, while impinging on the airfoil leading edge. It then flows aft through opening 32 and down cavity 28 while impinging on the airfoil midspan. An alternate to this arrangement would be to close opening 32 and add an opening at 34 at the bottom of cavity 28. Both cavities would then flow upward.

Figure 3:
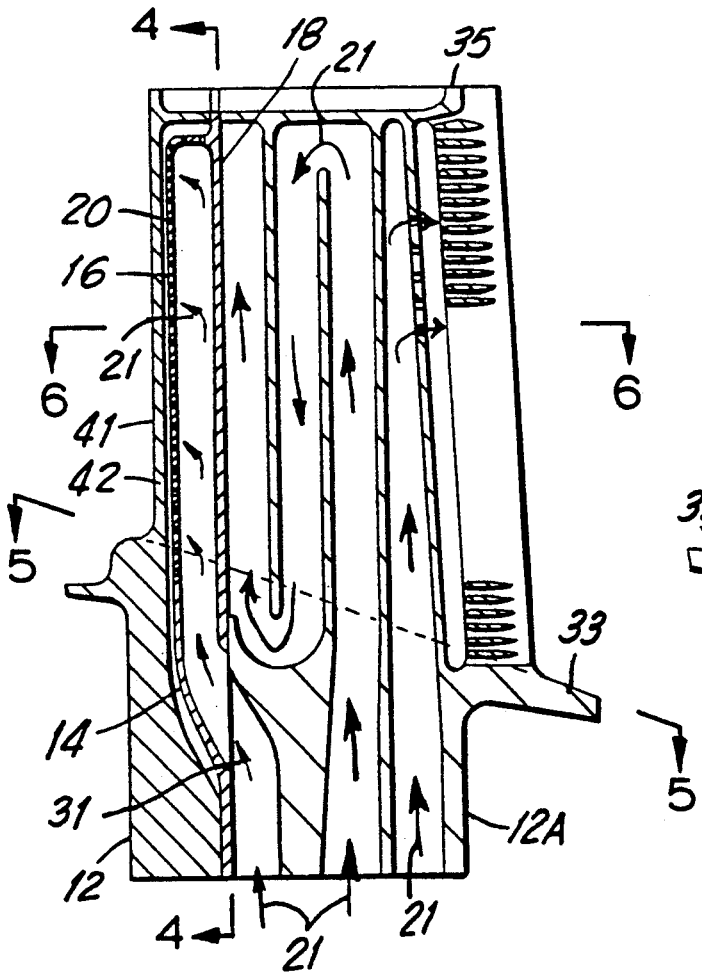
FIG. 3 is a plan cross-sectional view through a turbine blade constructed in accordance with the present invention.
Figure 4:
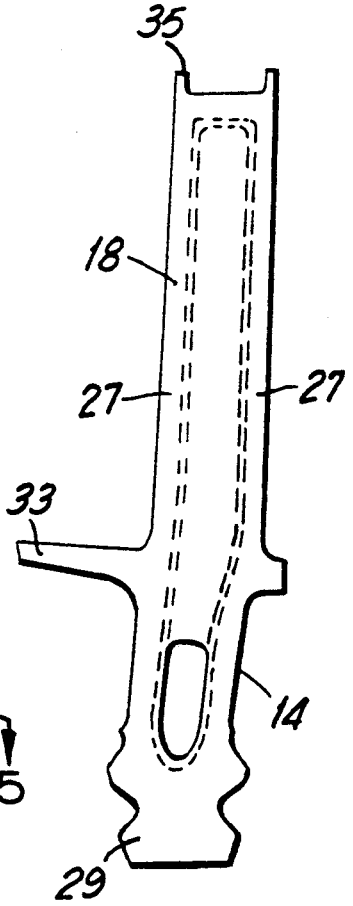
FIG. 4 is an aft view of the impingement baffle of FIG. 3 taken along line 4—4 of FIG. 3 and looking forward.

As seen in both FIGS. 3 and 8, cooling air 21 does not enter the impingement baffle immediately from the bottom of the turbine blade but rather flows through a mild forward turn 31 prior to entering the airfoil portion of the baffle. As further seen in these Figures, the baffle support plate 18 in FIG. 3 and the rear surface of aft cavity 28 in FIG. 8 form a portion of an aft cooling air passage.

Obviously, numerous modifications and variations of the present invention are possible in the light of the above teachings. It is therefore to be understood that within the scope of the appended claims, the invention may be practiced otherwise than as specifically described herein.

What is claimed is:

1. An impingement-cooled turbine blade, comprising:

a front blade portion;

an aft blade portion;

a tubular impingement baffle integrally-bonded to and separating said front and aft blade portions along an entire radial height of said blade, said baffle extending from a tip portion of said blade through a dovetail portion of said blade and wherein said baffle includes a substantially planar baffle support plate having a periphery; and a blade airfoil outer surface comprising a portion of an outer surface of said front blade portion, a portion of an outer surface of said aft blade portion and a portion of said periphery of the support plate.

2. The turbine blade of claim 1, wherein said impingement baffle further comprises an airfoil-shaped perforated impingement portion having opposite sides, wherein said substantially planar baffle support plate extends transversely to said opposite sides and is integrally connected to each of said opposite sides thereby forming an airflow cavity with said impingement portion.

3. The turbine blade of claim 2, wherein said substantially planar baffle support plate comprises a pair of flanges projecting transversely from said impingement portion.

4. An impingement baffle for use in a gas turbine engine blade, said baffle comprising a tubular body having a perforated airfoil-shaped front portion and a substantially planar support plate extending transversely to opposite sides of said front portion and integrally connected to an aft portion of each of said opposite sides of said front portion, wherein said substantially planar support plate forms a radially extending boundary of said tubular body, said substantially planar support plate comprising connecting means projecting transversely from said opposite sides of said front portion for connecting said baffle to said turbine engine blade.

5. The impingement baffle of claim 4, wherein said tubular body comprises a forward cavity and an aft cavity, wherein said substantially planar support plate is disposed between said forward and aft cavities and wherein said substantially planar support plate forms a radially extending boundary for each of said forward and aft cavities.

6. The impingement baffle of claim 4, further comprising a dovetail portion formed on one end of said baffle.

7. An impingement-cooled turbine blade comprising a dovetail portion, a platform portion and an airfoil portion having an outer surface and an impingement baffle disposed within said turbine blade and bonded along each of said dovetail, platform and airfoil portions, wherein said baffle includes a substantially planar support plate having a periphery, said periphery extending radially from a tip portion of said blade through said dovetail portion, and wherein said outer surface of said airfoil portion comprises a portion of said periphery.

8. The turbine blade of claim 7, wherein said impingement baffle further comprises a perforated, airfoil-shaped portion having opposite sides, wherein said substantially planar support plate extends transversely to said opposite sides and is integrally connected to each of said opposite sides thereby forming a portion of a boundary of a forward airflow cavity, said airfoil-shaped portion forming a remainder of said boundary of said forward airflow cavity.

9. The turbine blade of claim 8, wherein said support plate comprises connecting means for mounting said impingement baffle within said turbine blade.

10. The turbine blade of claim 9, wherein said connecting means comprises a pair of flanges projecting from opposite sides of said perforated airfoil-shaped portion.

11. The turbine blade of claim 10, wherein said flanges are diffusion bonded to said airfoil portion of said turbine blade.

12. The turbine blade of claim 3, wherein said portion of said periphery forms a smooth contour with said portion of said outer surface of said front blade portion and said portion of said outer surface of said aft blade portion.

13. The turbine blade of claim 12, wherein said front blade portion includes an aft surface and said aft blade portion includes a front surface, and wherein said baffle is diffusion bonded to each of said aft and front surfaces along said entire radial height of said blade.

14. The turbine blade of claim 10, wherein said flanges are positioned between and diffusion bonded to front and aft portions of said dovetail, platform and airfoil portions.

* * * * *